United States Patent [19]

Mar

[11] Patent Number: 4,512,484

[45] Date of Patent: Apr. 23, 1985

[54] LOCKING SCREW CAP

[76] Inventor: Bob Mar, 1025 Rosemarie La., Apt. D-8, Stockton, Calif. 95207

[21] Appl. No.: 354,263

[22] Filed: Mar. 3, 1982

[51] Int. Cl.[3] ..... B65D 55/02

[52] U.S. Cl. ..... 215/221; 206/1.5; 215/218

[58] Field of Search ..... 215/217, 218, 219, 221, 215/273, 330; 206/1.5; 220/315

[56] References Cited

U.S. PATENT DOCUMENTS 3,376,992 4/1968 Klapp, Sr. ..... 215/221

3,514,003 5/1970 Fitzgerald ..... 215/221

*Primary Examiner*—George T. Hall

*Attorney, Agent, or Firm*—Townsend & Townsend

[57] ABSTRACT

A locking screw cap for sealing a wide variety of containers, such as medicine bottles, bottles containing hazardous liquids, and other containers where it is desired to prevent access by young children, includes a locking pin mounted in a bracket on the perimeter of the cap. The locking pin may be depressed to engage one or more lugs formed adjacent the opening in the container to prevent rotation of the cap. A flange formed on the top of the locking pin and a tang formed in the middle of the locking pin prevent removal of the pin from the bracket. The user may raise the pin by inserting a fingernail in a slot formed in the tang to urge the pin upward.

8 Claims, 4 Drawing Figures

LOCKING SCREW CAP

BACKGROUND OF THE INVENTION

1. Field of the Invention

The present invention relates generally to safety caps for medicine bottles and the like, and more particularly it relates to a screw-type safety cap which may be locked to prevent young children from opening it.

Various state and federal regulations require that medicine bottles, poison bottles, and the like, have safety caps which cannot be opened by young children. Such caps are typically tested by placing them in the hands of children below the age of five years and are considered successful if a large percentage of the children are unable to open them within a five minute period. Such caps must, however, be readily openable by an adult, and it is expected that as a child matures, he will also be able to open them.

2. Description of the Prior Art

A number of containers with safety caps or stoppers have been invented. In one design, the user must obtain the correct rotational alignment between a lug on the cap and an opening in the container lip so that the cap can be lifted off. In another design, the user must simultaneously push the cap downward against the container lip and rotate the cap relative to the container so that the threads on the container engage those on the cap, and the cap can be screwed off the container.

Both these approaches have been reasonably successful in confounding young children and preventing them from gaining access to potentially harmful products inside the containers. Unfortunately, such locking caps have often bewildered the adult who wishes to use the bottled product. For example, with the first prior art locking-cap cited above, even after the user has managed to align the lug with the opening in the bottle lip, the tightness of the fit often makes it difficult to pry off the bottle cap. In the second example, the instructions which are printed on the bottle cap ("press down before turning") are considered by many to be ambiguous and by others to be downright deceptive.

It is therefore desirable to provide a locking container cap which requires sufficient skill and perception so that young children are unable to fathom its intricacies, while being sufficiently straightforward and obvious in operation so that adults and more mature children are able to remove the cap without difficulty.

SUMMARY OF THE INVENTION

The present invention provides a screw cap having a locking mechanism which is sufficiently unapparent and difficult to actuate so that young children are effectively prevented from opening the container, while remaining sufficiently fathomable and easy to operate so that adults and mature children are able to remove the cap. Such operation is achieved by providing a locking pin on the cap which may be extended downward to engage one or more lugs integrally formed on the container. When the locking pin thus engages the lugs, rotation of the cap will be prevented and the cap cannot be removed.

In the disclosed embodiment, the locking pin is secured to the cap in a bracket formed along the outer perimeter of the cap. The pin is frictionally held within the bracket so that it remains either in its extended or retracted position until manually shifted by the user. Stop means are provided on the pin for limiting its travel in both directions so that the pin cannot be removed from the bracket. A narrow slot formed on the pin allows the user to shift the position of the pin by inserting his fingernail into the slot and applying the necessary force.

The locking pin terminates at its lower end in a pair of forks which engage openings defined by three lugs formed on the container adjacent its opening. The complementary threads formed on the locking cap and the container are aligned so that the locking pin will lie substantially above the mating lugs when the cap is fully screwed on. The provision of two forks and three lugs provides a particularly sturdy locking mechanism which will withstand attempts to screw off the cap when the locking mechanism is engaged.

The present invention can provide a locking safety cap for many types of containers commonly found in the home. The invention is particularly useful with medicine bottles, bottles holding hazardous liquids, and the like where it is desired to prevent young children from having access to the contents.

The present invention will be better understood from the following description considered in connection with the accompanying drawings in which a preferred embodiment of the invention is illustrated by way of example. The drawings are for the purpose of illustration and description only and are not intended as a definition of the limits of the invention.

DESCRIPTION OF THE PREFERRED EMBODIMENT

Figure 1:
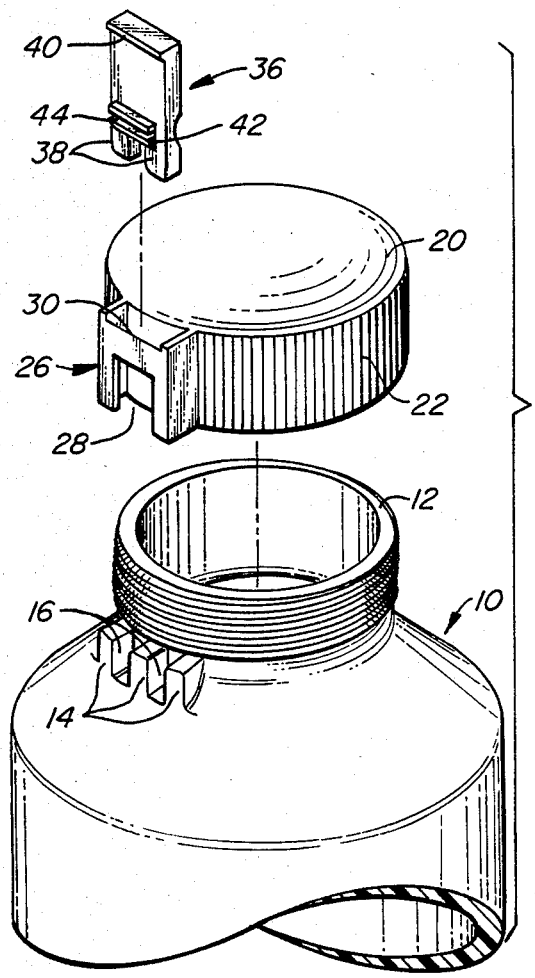
FIG. 1 is an exploded view of the locking safety cap of the present invention shown in isometric.
Figure 2:
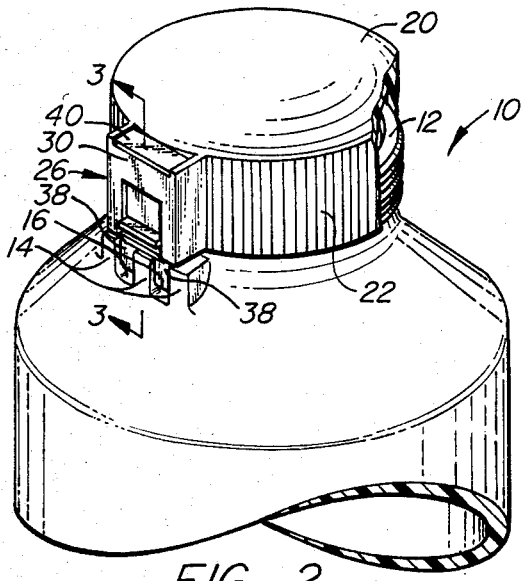
FIG. 2 is an isometric view of the assembled locking safety cap of the present invention.

Referring to FIGS. 1 and 2, a container 10 having a threaded opening 12 is illustrated. The container may hold a wide variety of substances such as medicines, hazardous liquids including bleaches, cleaning fluids, toxic chemicals, and other items commonly found in the household, all of which should not fall into the hands of young children. The container may be formed from a wide variety of substances, including metals, plastics and glass.

One or more lugs 14 are formed in the body of the container 10 adjacent the threaded opening 12. In the embodiment illustrated, three spaced-apart lugs 14 define a pair of recesses 16 there between. Aside from having the lugs 14, the container 10 is a conventional screw-top container as commonly found in the household.

A cap 20 includes a cylindrical side wall 22 which defines a threaded lip which engages the threaded opening 12 on the container 10. Thus, in the absence of the locking mechanism discussed here below, the cap 20 may be screwed off and on the threaded opening 12 of the container 10 to form a tight seal and protect the contents of the container from the outside.

A bracket 26 projects outward from the threaded lip 22 of the cap 20 and defines a channel 28 (FIG. 1) therethrough. A bar 30 extends across the front face of the bracket 26 to complete the enclosure.

A locking pin 36 is slidably received within the channel 28 of the bracket 26. The locking pin 36 terminates at its lower end (as viewed in each of the Figures) in a pair of forks 38 having a size selected to mate with the recesses 16 formed between the lugs 14. The threads on both the opening 12 and the cap 20 are formed so that the bracket 26 lies substantially above the lugs 14 when the cap is tightly screwed on. In this way, the locking pin 36 may be depressed, as described in more detail hereinafter, so that the forks 38 enter the recesses 16 to prevent further rotation of the cap 20.

In the embodiment illustrated, the tightness of the cap 20 is somewhat adjustable. Referring specifically to FIG. 2, if the cap 20 is further tightened (by clockwise rotation), the locking pin 36 would be able to engage the left-most lug 14, rather than the center lug 14 as illustrated. Similarly, the pin 36 would engage the right-most lug 14 if the cap is screwed on less tightly.

In an alternative embodiment (not illustrated), lugs could be provided all around the neck of the bottle. In that way, the cap could be adjusted to any tightness desired and the manufacturer would not have to worry about aligning the threads.

Figure 3:
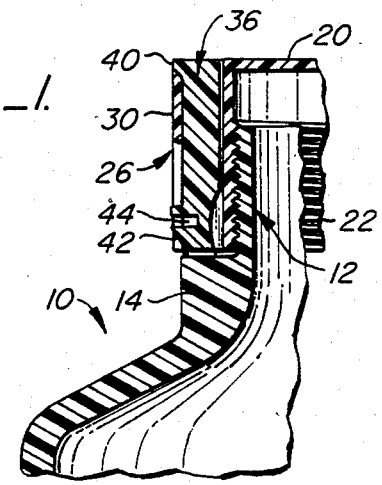
FIG. 3 is a sectional view taken along line 3—3 of FIG. 2.
Figure 4:
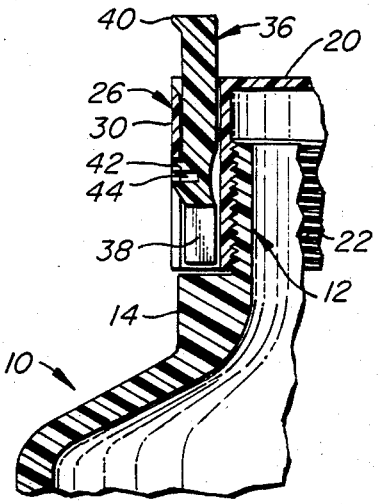
FIG. 4 is a view similar to that of FIG. 3 except that the locking mechanism is shown in its disengaged configuration.

The locking pin 36 includes a flange 40 formed at its upper end and a tang 42 formed just above the forks 38. Referring now in particular to FIGS. 3 and 4, the flange 40 seats against the upper edge of the bar 30 when the pin is depressed fully downward (FIG. 3). Conversely, the upper surface of the tang 42 seats against the lower surface of the bar 30 when the pin 16 is urged fully upward. Thus, the flange 40, the tang 42 and the bar 30 comprise a limiting means which prevents the pin 16 from being pulled from the bracket 26. This is, of course, desirable to prevent loss of the pin 16.

The cross-sectional dimensions of the pin are chosen to correspond to the internal dimensions of the bracket 26. It is preferred that the pin 16 fit in the bracket 26 quite snugly so that the pin will not shift positions unless intentionally shifted by the user. In this way, the lock will remain engaged, even though the container 10 may be subjected to rough treatment. This is particularly important since children may be expected to attempt various indirect methods for opening the container.

A slot 44 is formed in the tang 42 so that the user may insert a fingernail to pull the locking pin 16 upward. The pin 16 may be depressed simply by pushing downward on the top flange 40 of the pin.

The locking pin 36 is shown in its downward or locked position in FIGS. 2 and 3. As best seen in FIG. 2, the forks 38 are received within the recesses 16 formed between adjacent lugs 14. The mating of the forks 38 and the lugs 14, of course, prevents the lateral movement of the pin 36 which in turn prevents the rotation of the cap 20. In order to turn the cap 20 to remove it, it is necessary that the locking pin 36 be raised to the position illustrated in FIG. 4.

Because of the specific design of both the locking pin 36 and the bracket 26, the pin 36 may be raised only by engaging the slot 44 with a fingernail or some implement capable of being inserted into the slot. As best observed in FIG. 3, the flange 40 mates tightly with the upper edge of the bar 30 and provides no access for grasping the pin 16. Similarly, the lower surface of the tang 42 is bevelled so that it is difficult to engage and provides little opportunity to raise the pin. Thus, only by engaging the slot 44, is it possible to raise the pin 36 and allow the cap 20 to be removed. For particularly hazardous contents, it will sometimes be desirable to enclose the pin 36 in the bracket 26 so tightly that an implement, such as a screwdriver, is required to raise the pin.

For particularly large diameter screw caps, it will usually be desirable to provide two or more locking pins to assuure that the cap is prevented from turning. In such a case, the container will include lugs all around its periphery to facilitate alignment of the cap and the container.

Such construction is particularly useful in providing a locking cap intended to thwart the efforts of young children, while allowing adults relatively easy access to the contents of the container. Young children are prevented from opening the cap at two levels. First, it is unlikely that a child could determine the action necessary to free the cap so that it could be twisted off. On the other hand, an adult with even the most rudimentary mechanical knowledge, can ascertain that the pin must be raised in order to unscrew the cap. At the second level, even if a child realizes that the pin should be raised, it will be difficult for quite young children to realize that they can elevate the pin by placing their fingernail in the slot. Moreover, for the youngest children, the physical act of raising the pin will often prove insurmountable. Again, for adults, observation of the cap will quickly reveal how the pin can be raised, and the physical act of raising the pin will provide little or no difficulty.

While the preferred embodiment of the present invention has been illustrated in detail, it is apparent that modification and adaptations of the embodiment will occur to persons skilled in the art. For example, the number of lugs provided may vary and it is necessary only that means be provided for the locking pin to engage the container in some way. Moreover, the specific locking mechanism can be applied to a wide variety of twist caps where rotation of the cap is required for mounting and de-mounting the cap. It is to be expressly understood that such modifications and adaptations are within the spirit and scope of the present invention as set forth in the following claims.

What is claimed is:

1. A system for sealing containers, said system comprising:

a container having a threaded opening and at least one lug formed adjacent said opening;

a screw cap capable of threadably engaging the threaded opening to seal the container;

a bracket formed at the periphery of the cap; and a pin slidably received in the bracket and having means at one end for engaging the lug, so that in an extended position the pin engages the lug to prevent rotation of the cap and in a retracted position the cap is free to rotate.

2. A system as in claim 1, wherein the pin includes stop means which define the extended and retracted positions.

3. A system as in claim 2, wherein the container has three lugs which together define a pair of openings, and wherein the pin includes a pair of forks which engage the openings when the pin is in its extended position.

4. A system as in claim 1, wherein the manual means for shifting the pin is a slot capable of engagement by a fingernail.

5. In a container having threaded opening and a screw-type cap, a locking mechanism for preventing removal of the cap by young children, said locking mechanism comprising:

at least one lug formed on the container adjacent the opening;

a bracket formed on the periphery of the cap at a location so that the bracket will be substantially aligned with the lug when the cap is fully screwed on; and a pin slidably received in the bracket so that the pin engages the lug to prevent rotation of the cap when the pin is in an extended position, and the pin is clear of the lug to allow rotation of the cap when the pin is in a retracted position.

6. A container as in claim 5, wherein the pin includes a top flange which mates with the bracket when the pin is in its extended position to prevent the pin from being withdrawn from the cap.

7. A container as in claim 6, wherein the pin includes a tang which mates with the bracket when the pin is in its retracted position to prevent the pin from being withdrawn from the cap.

8. A container as in claim 7, wherein the tang includes a slot capable of receiving the fingernail of a user so that the pin may be shifted between its extended and retracted positions.

* * * * *